US005099783A

United States Patent [19]

Bourgeois

[11] Patent Number: 5,099,783

[45] Date of Patent: Mar. 31, 1992

[54] DOCTOR BLADE CAP

[75] Inventor: Robert A. Bourgeois, Orland Park, Ill.

[73] Assignee: Graco Inc., Minneapolis, Minn.

[21] Appl. No.: 510,119

[22] Filed: Apr. 17, 1990

[51] Int. Cl.[5] ..... B05C 1/00

[52] U.S. Cl. ..... 118/213; 118/406; 101/119; 101/120; 101/123; 101/124

[58] Field of Search ..... 101/114, 119, 120, 123, 101/124, 115, 155, 156, 157, 167, 168, 169; 118/100, 213, 406, 504

[56] References Cited

U.S. PATENT DOCUMENTS

| | | | |
|---|---|---|---|
| 3,592,132 | 7/1971 | Weber | 101/119 |
| 3,735,730 | 5/1973 | Mitter | 118/213 |
| 3,848,992 | 11/1974 | Smith | 101/169 |
| 4,048,919 | 9/1977 | Woods | 101/148 |
| 4,232,601 | 11/1980 | Mitter | 101/120 |
| 4,393,775 | 7/1983 | Cappel et al. | 101/365 |
| 4,503,700 | 3/1985 | Kishikawa et al. | 75/225 |
| 4,627,345 | 12/1986 | Watts | 101/119 |
| 4,693,179 | 9/1987 | Watts | 101/119 |
| 4,870,899 | 10/1989 | Bowden | 101/155 |
| 5,001,979 | 3/1991 | Kürten | 101/123 |

FOREIGN PATENT DOCUMENTS

| | | | |
|---|---|---|---|
| 0061093 | 9/1982 | European Pat. Off. | 101/169 |

OTHER PUBLICATIONS

Microprint TM Brochure, "Revolutionary New Hot Melt Application Technology," (1987), 4 pp.

*Primary Examiner*—Edgar S. Burr
*Assistant Examiner*—Christopher A. Bennett

[57] ABSTRACT

A doctor blade for use in an adhesive screen printing apparatus is formed of a main blade member of spring steel along with a U-shaped cap. The cap is ideally formed of a filled nylon material and is attached to the blade member with a silicon RTV compound. The use of this construction results in much more even laydown of adhesive from pattern to pattern and from the left and right hand sides of the screen. Use of the invention also serves to increase screen life.

4 Claims, 1 Drawing Sheet

DOCTOR BLADE CAP

BACKGROUND OF THE INVENTION

Adhesive screen printers are well known in the art for the application of various patterns of hot melt adhesive. Such printers are typified in U.S. Pat. Nos. 4,627,345 and 4,693,179, the contents of which are hereby incorporated by reference. Such machines are sold under the trademark Microprint ® by the assignee of the instant invention. Such devices may sometimes suffer from uneven application of material to the substrate, that is, there is a variation in the amount of adhesive from pattern to pattern or from the left to the right side of the screen.

It is therefore an object of this invention to provide a screen printing device and in particular doctor blade assembly which is capable of even application of adhesive both from pattern to pattern and from side to side of the screen.

It is further an object of this invention to provide a doctor blade which is easily and inexpensively manufactured and which will serve to improve screen life.

SUMMARY OF THE INVENTION

The doctor blade of the instant invention is formed by utilizing a conventional doctor blade formed by spring steel and adding a U-shaped cap to the screen edge of the blade. The cap is ideally formed of an MDS filled nylon and is attached to the spring steel blade using a silicon RTV compound.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
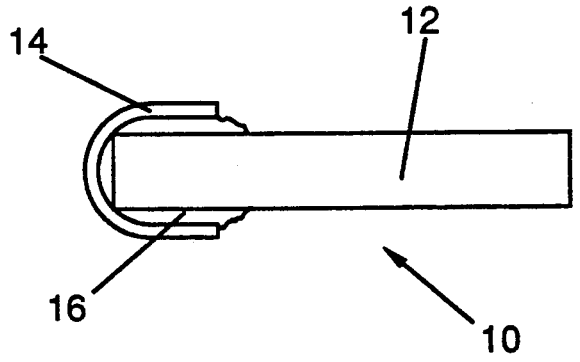
FIG. 1 is an end view showing the doctor blade with cap.
Figure 2:
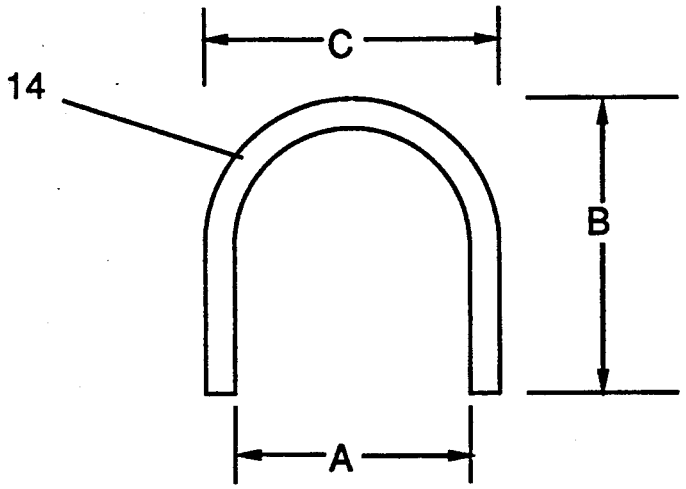
FIG. 2 is a cross-sectional view of the cap for the doctor blade.

The doctor blade of the instant invention, generally designated 10, is comprised of a blade member 12 and a cap 14. Blade member 12 is generally made of a spring steel material and in the preferred embodiment is 0.009 inches thick and 1 inch wide. The cap 14 is ideally formed as a generally U-shaped extrusion as shown in FIG. 2 and is attached in place by a silicon RTV (room temperature vulcanizing) silicon compound. The cap is desirably formed of an MDS (molybdenum disulfide) filled nylon such as that sold by McMaster-Carr under the material specification 8721K12. The doctor blade is preferably located a relatively small predetermined distance from the screen.

In the preferred embodiment, the dimension A shown in FIG. 2 has a maximum of 0.031 inches. The dimension shown as B is desirably between 0.340 and 0.341 inches while the dimension shown as C in FIG. 3 is between 0.220 inches and 0.245 inches.

Compared to a standard spring steel blade, the doctor blade of the instant invention has yielded a 40% improvement in pattern to pattern variation while side to side variation was improved by approximately 180%. Further, wear on the screen has substantially improved as well with the instant invention.

It is contemplated that various changes and modifications may be made to the doctor blade without departing from the spirit and scope of the invention as defined by the following claims.

What is claimed is:

1. A hot melt adhesive screen printing apparatus comprising a cylindrical screen and a doctor blade located therein, the improvement wherein said doctor blade comprises:

a spring steel main blade member having an attachment edge and a pressure edge; and a filled nylon blade cap U-shaped in cross section and affixed over said pressure edge, located a relatively small predetermined distance from said screen.

2. The adhesive screen printing apparatus of claim 1 wherein said cap is affixed to said blade member with a silicon RTV compound.

3. The adhesive screen printing apparatus of claim 1 wherein said cap is formed of an MDS filled nylon.

4. A hot melt adhesive screen printing apparatus comprising a cylindrical screen and a doctor blade located therein, the improvement wherein said doctor blade comprises:

a spring steel main blade member having an attachment edge and a pressure edge; and an MDS filled nylon blade cap U-shaped in cross section and adhesively affixed over said pressure edge, located a relatively small predetermined distance from said screen.

* * * * *